United States Patent [19]

Hersberger et al.

[11] 4,196,582

[45] Apr. 8, 1980

[54] CONTROL DEVICE FOR AN ELECTRONIC WATCH

[75] Inventors: Pierre Hersberger, Neuchâtel; Rémy Grandjean, Fontainemelon, both of Switzerland

[73] Assignee: Ebauches S.A., Neuchâtel, Switzerland

[21] Appl. No.: 841,214

[22] Filed: Oct. 11, 1977

Related U.S. Application Data

[63] Continuation of Ser. No. 641,653, Dec. 17, 1975, abandoned.

[30] Foreign Application Priority Data

Jan. 6, 1975 [CH] Switzerland ..... 49/75

[51] Int. Cl.[2] ..... G04B 19/34

[52] U.S. Cl. ..... 368/70; 368/82; 368/107; 368/256

[58] Field of Search ..... 58/23 R, 50 R, 85.5

[56] References Cited

U.S. PATENT DOCUMENTS

| | | | |
|---|---|---|---|
| 3,630,015 | 12/1971 | Lehovec | 58/50 R |
| 3,795,099 | 3/1974 | Tsuruishi | 58/50 R |
| 3,889,458 | 6/1975 | Kashio | 58/50 R X |
| 3,922,847 | 12/1975 | Culley et al. | 58/23 R X |
| 3,939,640 | 2/1976 | Kahn | 58/50 R X |
| 3,971,012 | 7/1976 | Morokawa et al. | 58/50 R X |
| 4,006,585 | 2/1977 | Tamaru et al. | 58/50 R |

*Primary Examiner*—Ulysses Weldon
*Attorney, Agent, or Firm*—Imirie and Smiley

[57] ABSTRACT

A control device for controlling the display of an electronic watch capable of providing two different types of information. The control device enables selection of the information to be displayed and differentiation between the two types of display available.

3 Claims, 5 Drawing Figures

CONTROL DEVICE FOR AN ELECTRONIC WATCH

CROSS REFERENCE TO RELATED APPLICATION

This application is a continuation of application Ser. No. 641,653, filed Dec. 17, 1975, now abandoned.

BACKGROUND OF THE INVENTION

The present invention concerns a device for controlling a display of an electronic watch capable of supplying two items of information of different types, comprising a selection circuit permitting the choice of the information to be displayed.

In particular, in electronic watches, several sorts of display are known which may be classified as a function of the frequency response thereof. There are two main types of display, namely, liquid crystal displays and light-emitting diode displays (LED).

The frequency response of electro luminescent diodes is very rapid; it is considered that a rise time or decay time of 10ns is a typical value.

The frequency response characteristic of the human eye is much inferior. Above approximately 30 Hz man can perceive no more than a continuous emission. This shows that the power consumed can be reduced by driving the display in a pulse mode.

To limit still further the consumption of current, watches have been designed the display of which is composed of only 4 digits; each digit being a 7 segment display with which it is possible to represent at least the Figures from 0–9. By means of these 4 digits it is possible to display either two sets of information, each comprising two digits, or three sets , one of which will occupy two digits, and the other two, the remaining two digits.

The object of the present invention is to provide a device by which it is possible to display different sets of information in one and the same display and making it possible to distinguish the nature of this display. This may concern, besides the indication of the time, a timed interval, a temperature, pressure, or even the result of the calculation of a small calculating machine.

SUMMARY OF THE INVENTION

According to the present invention there is provided a device for controlling the display of an electronic watch capable of supplying two sets of information of different types, comprising a selection circuit for permitting the selection of the information which is to be displayed, an interface controlled by a control signal, which control signal also selects the information to be displayed, the interface enabling modification of the appearance of the display according to the nature of the displayed information.

BRIEF DESCRIPTION OF THE DRAWINGS

The present invention will be described further, by way of example, with reference to the accompanying drawings, in which.

DETAILED DESCRIPTION OF THE DRAWINGS

Figure 1:
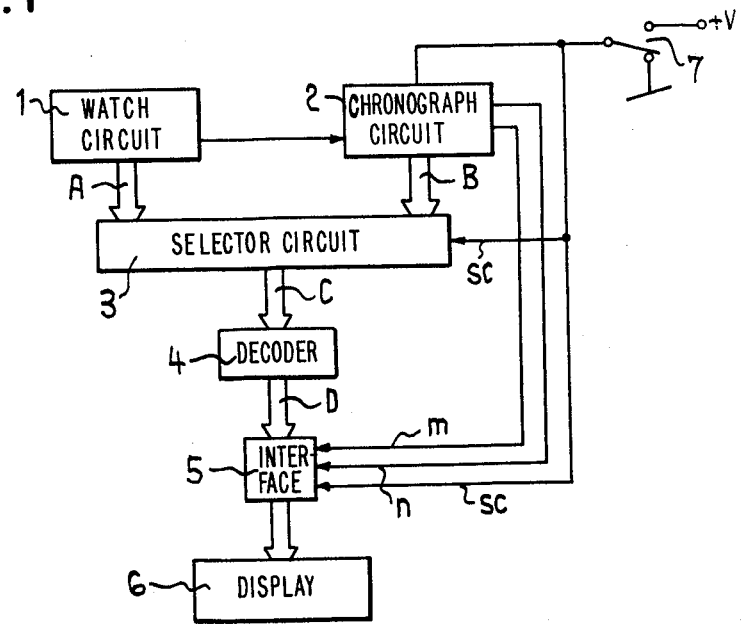
FIG. 1 is a schematic view of an embodiment according to the present invention using a single display to indicate either the time or a timed interval.

In FIG. 1, the watch has a first watch circuit 1 containing the oscillator and the conventional divider chain for indicating the time. The circuit 2 is a chronograph circuit, connected to the watch circuit 1 for enabling the timing of any lapse of time. These two circuits supply their respective coded information A and B to a selection circuit 3 by means of which it is possible to select one of the two information A or B to be transmitted to output C. The selected information is then decoded in a decoder 4, which transmits an information D into and interface 5 before proceeding to feed a display 6. A switch 7 activates the chronograph circuit 2, and the selector 3 and controls the interface 5. This interface 5 uses the items of information m and n of the chronograph circuit 2.

Figure 2:
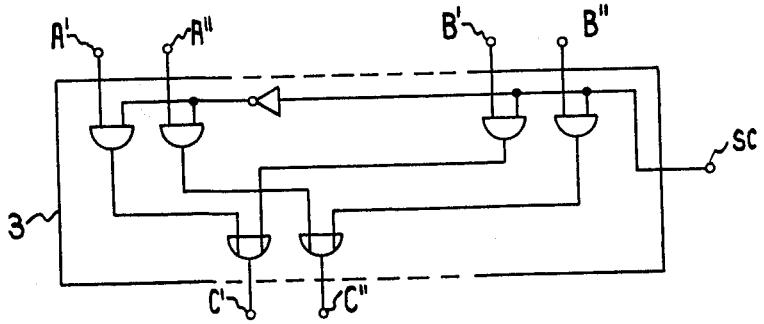
FIG. 2 shows part of the arrangement shown in FIG. 1.

FIG. 2 shows in part how the selector 3 may be constructed. According to the state of a control signal SC, the selector allows, either the items of information A' and A" or the items of information B' and B", which form part of the information A and B respectively to be transmitted to the outlet. As indicated in FIG. 2 by a broken line informations A and B usually include more than two items of information.

Figure 3:
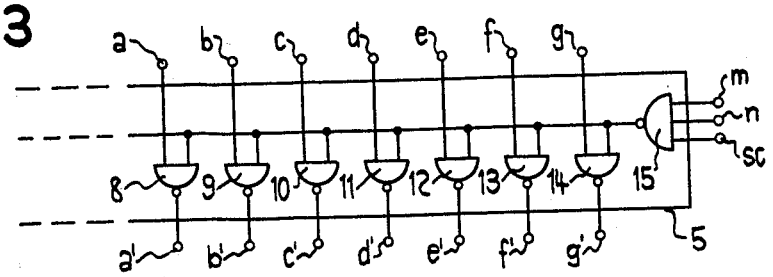
FIG. 3 shows another part of the arrangement shown in FIG. 1.

FIG. 3 shows a portion of the interface 5. The decoder 4 supplies a decoded information D, each line of which can drive a segment of the display. If the display comprises 4 digits each having seven segments, the information D will need 28 lines for driving the display 6. FIG. 3 only shows 7 lines a, b, c, d, e, f, g, intended to guide the seven segments of a single digit. Each line a to g passes through a NAND gate 8 to 14. These NAND gates 8 to 14 are controlled by the opening of a NAND gate 15 having three inputs, one of which is provided by the control signal SC, the second by the signal m and the third by the signal n.

Figure 4:
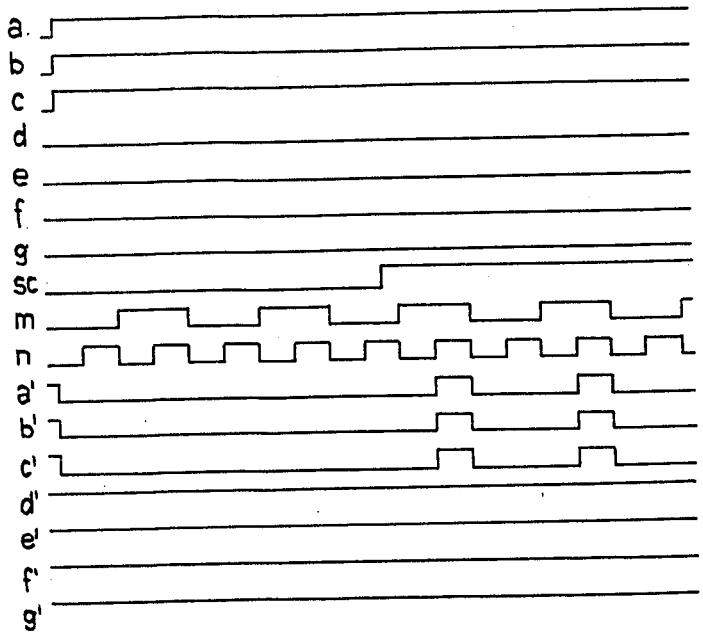
FIG. 4 is a diagram showing the sequence of operation of the device according to the invention.

FIG. 4 shows the operation of the device. It will be assumed that only the segments a, b and c have to be illuminated and for this they need a logic potential "0". It will then be assumed that if the control signal SC has a logic potential "0", the data of the watch circuit 1 will be displayed and if it has a logic potential "1", the display will indicate the data of the chronograph circuit 2.

In the first case, it will be seen that the outlet of the NAND gate 15 will remain on the logic potential "1", thus holding the NAND gates 8 to 14 continuously open. The time is thus displayed by continuously illuminated display elements such as leds. If, on the other hand, the control signal SC goes to a logic potential "1" and the signals m and n are constituted by, for example, trains of synchronous pulses, one of which has a frequency of 8Hz and the other a frequency of 16Hz, it will be seen that the outputs a', b' and c' will supply negative pulses having a duration of 3/16 of a second separated by intervals of 1/16 of a second. The human eye will then perceive blinking of the display whilst still being able to decipher the information The person wearing the timepiece always clearly understands, therefore, that a continuous display indicates the time while a blinking or flickering display indicates a chronographed period of time.

Figure 5:
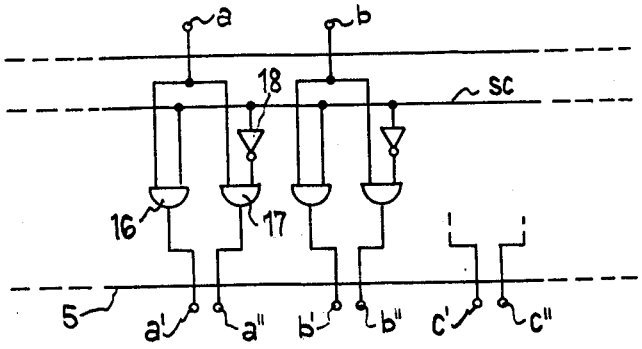
FIG. 5 shows a second embodiment according to the present invention.

FIG. 5 shows another embodiment of the device according to the invention. At present electro-luminescent diodes are known capable of emitting light of several different colours. These diodes comprise a common terminal as well as two other terminals a' and a"; the colour of the emitted light will depend on the electrode a' or a" selected to be activated. The control signal SC opens the AND gate 16 and closes the AND gate 17, by means of the inverter 18, or vice versa, in order to permit the information a to reach the terminal a' or the terminal a" of the corresponding segment. The same applies to the other segments with which the terminals b', b", c',c" etc. ate associated. This system of gates with an inverter permits direction of the information a, b, c . . . to the respective terminals a' or a", b' or b", c' or c" and so on.

We claim:

1. A device for controlling the display of an electronic watch capable of supplying two sets of information of different types, comprising means for producing a control signal, a selection circuit permitting the selection of the information which is to be displayed under control of said control signal, a controllable interface controlled by said control signal, the interface being controllable for selection and modification of the appearance of the display according to the nature of the displayed information, and the interface comprising a gate logically adding together two trains of pulses, derived from a timing circuit and the control signal, said gate having an output capable of actuating a plurality of gates through which the items of information to be displayed pass and capable of causing a perceivable blinking of the display.

2. A device as claimed in claim 1 wherein said controllable interface is responsive to the absence of said control signal to continuously direct the selected one set of information to said display and said controllable interface is responsive to the presence of said control signal and two other different frequency signals derived from said timing circuit, to intermittently direct the selected other set of information to said display at a rate such that said display blinks at a readily perceivable frequency.

3. An electronic timepiece comprising a display allowing alternative indication of the time and of chronographed time intervals, a time counting circuit and a chronograph circuit, a controllable selection circuit for selection of the information which is to be displayed either from said time counting circuit or from said chronograph circuit, decoder means responsive to said selected information for controlling said display to display the corresponding time or time interval, an interface electrically coupled to the output of said decoder means and being controllable for modification of the appearance of the display, means for generating a control signal and means for generating a blinking signal, said control signal acting simultaneously on said selection circuit and on said interface and said blinking signal acting on said interface, for control of a continuous display when said time counting circuit is selected for display and a perceivably blinking display when said chronograph circuit is selected for display.

* * * * *